US005447573A

United States Patent [19]

Christensen

[11] Patent Number: 5,447,573

[45] Date of Patent: Sep. 5, 1995

[54] PROCESS FOR CLEANING USED GAS PLANT FILTERS

[76] Inventor: James R. Christensen, Box 127, Lacombe, Alberta T0C 1S0, Canada

[21] Appl. No.: 180,297

[22] Filed: Jan. 12, 1994

[51] Int. Cl.[6] ..... B08B 7/02; B08B 7/04; B08B 3/08

[52] U.S. Cl. ..... 134/16; 134/10; 134/26; 134/25.1; 134/40; 134/32; 134/33; 134/22.1; 134/22.14; 134/22.19; 134/23

[58] Field of Search ..... 134/25.1, 26, 40, 10, 134/32, 33, 22.1, 22.14, 22.19, 23, 16; 55/242, 243; 95/281; 210/409, 413

[56] References Cited

U.S. PATENT DOCUMENTS

| | | | |
|---|---|---|---|
| 1,913,885 | 6/1933 | Jordahl | 55/242 |
| 4,545,789 | 10/1985 | Lato | 95/281 |
| 4,927,085 | 5/1990 | Oberg | 241/36 |
| 5,125,331 | 6/1992 | Wood | 100/37 |
| 5,136,934 | 8/1992 | Darby | 100/125 |
| 5,182,842 | 2/1993 | Ross | 29/240 |

FOREIGN PATENT DOCUMENTS

| | | | |
|---|---|---|---|
| 2606829 | 1/1977 | Germany | 55/242 |
| 2063530 | 3/1990 | Japan | 95/281 |
| 0363273 | 6/1973 | U.S.S.R. | 95/281 |
| 0663420 | 5/1979 | U.S.S.R. | 95/281 |

*Primary Examiner*—Melvyn J. Andrews
*Assistant Examiner*—Zeinab El-Arini
*Attorney, Agent, or Firm*—Robert W. B. Bailey

[57] ABSTRACT

A process of detoxifying gas plant filters for environmentally acceptable disposal involves immersing the filters in aqueous cleansing fluid in a tank, containing a suitable cleaning agent. When saturated they are then agitated and passed through compressing rollers to extract as much cleansing fluid as possible. The extracted cleansing fluid returns to the tank it came from. The filters are then subject to similar repetitive steps of immersion, saturation, agitation, compression and fluid extraction in subsequent tanks. Five such stages are provided usually with diminishing proportion of cleaning agent in the aqueous cleansing fluid. The last two stages are often rinsing with water, although this is not always the case. The cleaned filters meet environmental standards for landfill disposal. The toxin accumulate as sludge in the tanks and are periodically removed for disposal in approved hazardous waste disposal sites.

20 Claims, No Drawings

PROCESS FOR CLEANING USED GAS PLANT FILTERS

This invention relates to processes of cleaning used gas plant filters, to detoxify them for environmentally acceptable disposal. Such filters are used in gas plants to remove liquid and particulate matter, which nearly always includes toxins, classified or considered as hazardous waste, from natural and sour gas derived from gas and oilfields. The terms 'natural gas', 'sour gas', 'liquid matter', 'particulate matter', 'toxins' and 'hazardous waste' are well understood by those skilled in the art. The filter is typically cylindrical and composed of fibrous material through which the gas passes. The used filter is consequently full of concentrated toxins when discarded and disposal is a problem. The untreated used filters do not meet environmental standards for landfill burial and may be considered hazardous waste.

The amount of gas plant filters used to remove toxins from gas is vast, the disposal problem is equally so. Economic disposal of used gas plant filters requires that they be buried in landfill sites, which can not be achieved under current environmental regulations. Before the filters can be buried in landfill sites they must cleaned or detoxified to an acceptable level. In view of the number of gas plant filters used a process of cleaning them to allow their disposal in landfill is urgently required.

The present invention contemplates washing or cleaning the gas plant filters in suitable liquids to remove the toxins prior to disposing of the filters in landfill.

Although the invention will be described and referred to specifically as it relates to processes of washing or cleaning gas plant filters, for environmentally acceptable disposal, it will be understood that the principles of this invention are equally applicable to similar processes and accordingly, it will be understood that the invention is not limited to such processes.

BACKGROUND OF INVENTION

In order both to handle the large number of toxic gas plant filters and to be economically practical, the process must be capable of handling a plurality of gas plant filters at a time. Desirably the process should be automated as much as possible. Prior to devising this process applicant was not aware of any process in practical use for cleaning gas plant filters, which constitute a major environmental disposal problem.

PRIOR ART

Applicant has been unable to find prior art relating to gas plant filter cleaning. It is known to disassemble automotive oil filters to separate the filter components and crush them recover the oil, in U.S. Pat. Nos. 4,927,085 to Oberg, 5,125,331 to Wood, 5,136,934 to Darby, and 5,182,842 to Ross et al, which are not related to gas plant filters.

It is an object of the invention to provide a practical process for cleaning toxins from gas plant filters. It is a subsidiary object to wash, rinse, cleanse or clean gas plant filters containing toxins in suitable cleansing fluid to remove the toxins from the filters. It is a further subsidiary object to remove cleansing fluid from the washed, rinsed, cleanse or cleaned filters. It is a further object to remove as much liquid toxins as possible before application of cleansing fluid. It is a further object to immerse, saturate and agitate the filters in cleansing fluid to remove as much toxin as possible from the filters. It is an additional object to subject the filters to sequential batch cleaning. It is another subsidiary object to remove toxins from the filters, so that the washed, rinsed, cleansed or cleaned filters contain no toxins or at worst so little toxin they are acceptable for landfill burial under current environmental regulations. Other objects will be apparent to those skilled in the art from the following specification and appended claims.

DESCRIPTION OF THE INVENTION

The invention envisages use of apparati to carry out the process. The apparatus as described specifically herein is not contemplated as the sole possible apparatus usable in the inventive process, as those skilled in the art will be aware a number of widely different arrangements can be made to carry out the same functions.

In one broad aspect the process of the invention is directed to removing toxins from used gas plant filters by the steps of immersing used gas plant filters in cleansing fluid to saturate the filters with cleansing fluid, and then extracting the cleansing fluid from the saturated filters. The cleansing fluid is typically a mixture of water and suitable cleaning agents. Preferably additionally the process is repeated another time first immersing the filters in a second cleansing fluid, then extracting it from the saturated filters. The second cleansing fluid is physically distinct from the previous cleansing fluid and is usually chemically distinct also, having a different composition, although this is not always the case. The process may be repeated up to five times involving immersing the filters sequentially in five distinct cleansing fluids, then extracting the cleansing fluid from the filters. Most conveniently and preferably, before initiating immersion of the filters in cleansing fluid, liquid toxins are extracted from the filters.

In a second broad aspect the process of the invention for detoxifying used gas plant filters for environmentally acceptable disposal is directed to immersing used gas plant filters in cleansing fluid, then agitating them in the fluid to saturate the filters, followed by extracting the fluid. The previous step of extracting liquid toxin from the filters, is preferable before immersing them. Also the step of flattening one end of the filters prior to extracting said liquid toxin, is preferable. The saturated filters are preferably passed between roller means to extract the fluid. Similarly the filters are preferably passed between roller means to extract liquid toxin. The filter ends are flattened by compressing one end in hydraulic press means. Additionally the filters are placed on saturation table means, which immerses them in the cleansing fluid and then agitates in the fluid to saturate the filters. More preferably the process of immersing, agitating, and extracting is sequentially repeated in further cleansing fluids. Up to five cleansing fluids may be applied during the process.

In a further broad aspect the invention is directed to a process of detoxifying used gas plant filters for environmentally acceptable disposal. A plurality of used gas plant filters is assembled, one end of each filter is then flattened in hydraulic press means. The flattened ends are fed into a first pair of horizontal rollers, compressing the filters. Any liquid extracted from said filters drains into a containment tank means below the rollers. The filters are immersed in a first cleansing fluid within first saturation tank means, on first saturation table means. The filters are saturated with cleansing fluid, agitated on the table means, then conveyed on the table means to a second pair of horizontal rollers above the saturation tank means. The filters are then compressed between said rollers, allowing any liquid extracted from the filters to drain into the saturation tank means. Preferably the process includes sequentially repeating immersing, saturating, agitating conveying, compressing and allowing liquid to drain in second, third, fourth, and fifth saturation tank means.

Lastly the process advisably includes periodically removing toxins from the containment tank means and saturation tank means, for ultimate disposal.

The cleaning agent used in the process is typically a detergent, which is a laundry detergent, or a similar detergent used in the chemical industry, as it is necessary to use environmentally acceptable cleaning agents in the process. Solid detergents were dissolved until saturation and tested but although they worked to some extent they were not always satisfactory. Liquid detergents were then tested, the range explored was from 100% water to 100% liquid detergent by volume, by 5% steps, the detergent must be soluble in water, to form a single phase mixture or solution. Careful testing found the most effective mixture is 50% detergent:50% water by volume, which cleansed the most heavily contaminated filters. Greater amounts of detergent, for example 75% and 100% by volume, were not as effective. Although 50% by volume is the most effective cleansing fluid, it need only be used in the case of heavily contaminated filters. Generally lesser concentrations of detergent can be used in the initial saturation tank, with diminishing concentrations of detergent in later saturation tanks. The necessary concentrations can be routinely determined, and with experience estimated not only by those skilled in the art, but also by relatively unskilled personnel trained by those skilled in the art.

Not all detergents are equally effective, and routine determination as to effectiveness is advisable before employing a particular detergent—this determination again can be carried out by relatively unskilled personnel.

The aqueous cleaning agent solution, eventually with time, becomes contaminated with toxins, and must be discarded. The discarded solution or mixture is stored in drums for eventual transportation to a hazardous waste disposal site.

An apparatus used in the invention has a preferred preliminary loading tray about 3 feet deep by 7½ feet wide on which an array of several used gas plant filters are laid. One end of each filter is flattened or nipped between a filter press formed by a fixed lower flange beam and an upper hydraulically operated movable flanged beam, the flanged beams are mounted, the lower fixedly and the upper slidably, on side supports on either side of the loading tray. The upper movable beam is operable by hydraulic means, preferably paired hydraulic cylinders attached to an upper cross beam connecting the two side supports. The hydraulic means are, for safety reasons, preferably directly operated and controlled by an operative adjacent the loading tray.

A first set of rollers, about 7¼ feet wide, made from 7 inch diameter pipe with ½ inch walls is mounted horizontally adjacent the edge of the loading tray table, preferably with its gap level with it. The rollers engage the flattened or nipped ends of the gas plant filters, which are fed through them to extract liquid contaminant toxins. The rollers are hydraulically controlled and may be run either forward or reverse. A containment tank about 2 feet square, and about 7¼ feet wide surrounds the lower first roller and receives the liquid contaminant toxins extracted from the gas plant filters. The toxins are generally a sludge, which is periodically removed from the containment tank, stored in hazardous waste drums and disposed of at an environmentally approved hazardous waste disposal site.

The filters emerge from the first set of rollers onto a first saturation table in a first saturation tank. The tank is about 5 feet long, 7¼ feet wide and 2 feet deep, and contains cleansing fluid which is a mixture of water and suitable cleaning agent typically about 50—50 by volume although this may be varied depending on the dirtiness of the filters to be cleaned. The saturation table is slightly less in dimension than the tank so it fits within it. The table is pivotally mounted by opposed side A frames on a cross pipe which can be raised or lowered by paired hydraulic lift cylinders. The table also has parallel front and rear sprocket shafts, which engage, drive or rotate a conveyor covering the entire surface of the table, by side chains attached to the conveyor. The conveyor can thus move filters from one end of the tank to another, or back and forth. A hydraulic motor, is mounted on the table, and its motor sprocket chain drives side sprockets, on the table sprocket shafts, distinct from those engaging the conveyor. The table carrying the filters is lowered into the cleansing fluid, where they and it are agitated by moving the table for two or three or more minutes then the table is raised and the filters are fed by the conveyor into and through a second set of rollers identical to the first, over the first saturation tank. Dirty cleansing fluid is squeezed from the second set of rollers to fall back into the first saturation tank.

The filters emerge from the second set of rollers into a second saturation tank, identical in all respects to the first having a raisable and lowerable saturation table with a conveyor system and a set of rollers. The filters are similarly treated in the second saturation tank, lowered on the saturation table into the cleansing fluid, agitated, raised and fed through rollers, to squeeze the dirty cleansing fluid back into the saturation tank it came from.

As far as possible the dirty cleansing fluid is prevented from contaminating the next saturation tank.

The filters are sequentially treated in third, fourth and fifth saturation tanks, identically equipped to the first two. Generally the last two tanks (the fourth and fifth) contain water only and operate as rinsing tanks. If the filters are heavily contaminated they may operate as cleaning tanks. Generally the proportion of cleaning agent is diminished in each tank in turn, although this is a function of filter contamination.

The toxins generally settle out as sludge in the tanks, mostly in the containment tank and the first saturation tank, less so elsewhere. The toxins are periodically removed for temporary storage in drums, awaiting transfer to an approved hazardous waste disposal site.

Apart from the initial flattening or nipping press, the rollers and saturation tables are hydraulically controlled from a central location. The rollers and the saturation tables, and their associated raising and lowering devices and conveyors are independently operable. A total of eleven controls, one for each roller set, and one for each saturation table, together with a safety control have been found effective, although numerous other configurations may be used as those skilled in the art would be well aware. The safety control requires the operator of the system to maintain the switch in the 'ON' position, in the absence of the operator the system is automatically 'OFF'.

The system is conveniently arranged as one long tank separated into one containment tank and five saturation tanks. The rollers are equally conveniently independently driven by a drive train system along one side of the tank assembly. The tank assembly is also conveniently mounted on two longitudinal skids for motion.

When the filters have passed through the sixth and last set of rollers they are ready for disposal in landfill. Typically on passing through the last rollers, they fall into a large container of the dumpster type. The level of contamination is sufficiently reduced, even in heavily contaminated filters to allow disposal in landfill. The cleaned filters are in any event subject to spot checking and chemical analysis for toxins by appropriate provincial authorities and have been found environmentally acceptable under current regulations for landfill disposal.

As contemplated in the invention as soon as the first set of filters has entered the first saturation tank, the second set of filters may be assembled on the loading tray. Here their ends are flattened. The second set of filters may be fed through the first set of rollers onto the first saturation table while the first set of filters are fed through the second set of rollers onto the second saturation table. The device can and does process five sets of filters simultaneously in five different stages.

As those skilled in the art would realize these preferred described details and processes can be subjected to substantial variation, modification, change, alteration, and substitution without affecting or modifying the function of the described embodiments. Although embodiments of the invention have been described above, it is not limited thereto, and it will be apparent to persons skilled in the art that numerous modifications and variations form part of the present invention insofar as they do not depart from the spirit, nature and scope of the claimed and described invention.

I claim:

1. A process of detoxifying used gas plant filters for environmentally acceptable disposal comprising extracting liquid toxins form said filters then immersing said filters in cleansing fluid to saturate said filters with cleansing fluid; and wherein said cleansing fluid is selected from the group consisting of liquid water soluble detergents, water, and mixtures thereof.

2. A process of claim 1, comprising immersing said filters in a first cleansing fluid to saturate said filters with said first cleansing fluid; and extracting said first cleansing fluid from the saturated filters then immersing said filters in a second cleansing fluid chosen from said group of cleansing fluid to saturate said filters with said second cleansing fluid; and extracting said second cleansing fluid from the saturated filters.

3. A process of claim 1, additionally comprising subsequently immersing used gas plant filters in a third cleansing fluid to saturate said filters with said third cleansing fluid; and extracting said third cleansing fluid chosen from said group of cleansing fluid from the saturated filters.

4. A process of claim 3, additionally comprising subsequently immersing used gas plant filters in a fourth cleansing fluid to saturate said filters with said fourth cleansing fluid; and extracting said fourth cleansing fluid chosen from said group of cleansing fluid from the saturated filters.

5. A process of claim 4, additionally comprising subsequently immersing used gas plant filters in a fifth cleansing fluid to saturate said filters with said fifth cleansing fluid; and extracting said fifth cleansing fluid chosen from said group of cleansing fluid from the saturated filters.

6. A process of claim 1, said cleansing fluid containing water and up to 50% by volume of liquid water soluble detergent.

7. A process of detoxifying used gas plant filters for environmentally acceptable disposal comprising extracting liquid toxin from said filters then immersing said filters in cleansing fluid; and agitating said filters in said cleansing fluid to saturate said filters with cleansing fluid; and extracting said cleansing fluid from said saturated filters, wherein said cleansing fluid is selected from the group consisting of liquid water soluble detergents, water and mixtures thereof.

8. A process of claim 7, additionally comprising flattening one end of said filters prior to extracting said liquid toxin.

9. A process of claim 8, additionally comprising compressing one end of said filters in hydraulic press means to flatten said end.

10. A process of claim 7, additionally comprising passing said saturated filters between roller means to extract said cleansing fluid.

11. A process of claim 7, additionally comprising passing said filters between roller means to extract said liquid toxin.

12. A process of claim 7, additionally comprising placing said filters on saturation table means;

immersing said saturation table means in said cleansing fluid; and agitating said saturation table means in said cleansing fluid to saturate said filters.

13. A process of claim 7, comprising immersing and agitating said filters in a first cleansing fluid, and then extracting first cleansing fluid from said filters then immersing and agitating said filters in a second cleansing fluid, and then extracting said second cleansing fluid chosen from said group of cleansing fluid from said filters.

14. A process of claim 13, additionally comprising sequentially immersing and agitating said filters in a third cleansing fluid, and then extracting said third cleansing fluid chosen from said group of cleansing fluid from said filters.

15. A process of claim 14, additionally comprising sequentially immersing and agitating said filters in a fourth cleansing fluid, and then extracting said fourth cleansing fluid chosen from said group of cleansing fluid from said filters.

16. A process of claim 15, additionally comprising sequentially immersing and agitating said filters in a fifth cleansing fluid, and then extracting said fifth cleansing fluid chosen form said group of cleansing fluid from said filters.

17. A process of claim 7, said cleansing fluid containing water and up to 50% by volume of liquid water soluble detergent.

18. A process of detoxifying used gas plant filters for emvironmentally acceptable disposal comprising:

assembling a plurality of used gas plant filters;

flattening one end of each said filter in hydraulic press means;

feeding said flattened ends of said plurality of filters into a first pair of horizontal rollers;

compressing said filters between said rollers;

allowing any liquid extracted from said filters to drain into a containment tank means below said rollers;

immersing said filters in a cleansing fluid within saturation tank means, on saturation table means, said cleansing fluid containing water and up to 50% by volume of liquid detergent;

saturating said filters with cleansing fluid in said saturation tank means on said saturation table means;

agitating said filters in said cleansing fluid within said saturation tank means on said saturation table means;

conveying said filters on said saturation table means to a second pair of horizontal rollers above said saturation tank means; and compressing said filters between said rollers allowing any liquid extracted from said filters to drain into said saturation tank means.

19. A process of claim 18 additionally comprising sequentially repeating immersing, saturating, agitating conveying, compressing and allowing liquid to drain in at least one of said saturation tank means.

20. A process of claim 19 additionally comprising periodically removing toxins from said containment tank means and said saturation tank means.

* * * * *